US006652670B2

(12) United States Patent
Inoue et al.

(10) Patent No.: US 6,652,670 B2
(45) Date of Patent: Nov. 25, 2003

(54) STEEL SHEET AND METHOD FOR MANUFACTURING THE SAME

(76) Inventors: Tadashi Inoue, c/o NKK Corporation 1-2, Marunouchi 1-chome, Chiyoda-ku, Tokyo (JP); Yoichi Motoyashiki, c/o NKK Corporation 1-2, Marunouchi 1-chome, Chiyoda-ku, Tokyo (JP); Hiroyasu Kikuchi, c/o NKK Corporation 1-2, Marunouchi 1-chome, Chiyoda-ku, Tokyo (JP); Yasuhide Ishiguro, c/o NKK Corporation 1-2, Marunouchi 1-chome, Chiyoda-ku, Tokyo (JP); Sadanori Imada, c/o NKK Corporation 1-2, Marunouchi 1-chome, Chiyoda-ku, Tokyo (JP); Toru Inazumi, c/o NKK Corporation 1-2, Marunouchi 1-chome, Chiyoda-ku, Tokyo (JP)

( * ) Notice: Subject to any disclaimer, the term of this patent is extended or adjusted under 35 U.S.C. 154(b) by 0 days.

(21) Appl. No.: 09/837,435

(22) Filed: Apr. 18, 2001

(65) Prior Publication Data

US 2001/0050119 A1 Dec. 13, 2001

Related U.S. Application Data

(63) Continuation of application No. PCT/JP00/06639, filed on Sep. 27, 2000.

(30) Foreign Application Priority Data

| | | |
|---|---|---|
| Sep. 29, 1999 | (JP) | 11-275955 |
| Mar. 6, 2000 | (JP) | 2000-060282 |
| Apr. 20, 2000 | (JP) | 2000-119887 |
| Jun. 16, 2000 | (JP) | 2000-180903 |
| Sep. 5, 2000 | (JP) | 2000-268894 |

(51) Int. Cl.[7] ..... C21D 8/02; C22C 38/02; C22C 38/04; C22C 38/18

(52) U.S. Cl. ..... 148/320; 148/333; 148/334; 148/541; 148/547; 148/602; 148/661; 148/654

(58) Field of Search ..... 148/541, 547, 148/602, 661, 654, 320, 333, 334

(56) References Cited

U.S. PATENT DOCUMENTS

| | | | | |
|---|---|---|---|---|
| 4,436,561 A | * | 3/1984 | Takahashi et al. | 148/603 |
| 6,364,968 B1 | * | 4/2002 | Yasuhara et al. | 148/602 |

FOREIGN PATENT DOCUMENTS

| | | | | |
|---|---|---|---|---|
| JP | 354135616 A | * | 10/1979 | C21D/9/48 |
| JP | 358071330a | * | 4/1983 | C21D/7/00 |
| JP | 58-123823 A | | 7/1983 | |
| JP | 358164756 A | * | 9/1983 | C22C/38/14 |
| JP | 61-15929 B2 | | 4/1986 | |
| JP | 61-73829 A | | 4/1986 | |
| JP | 63-67524 B2 | | 12/1988 | |
| JP | 2555436 | * | 7/1990 | C22C/38/00 |
| JP | 4-88125 A | | 3/1992 | |

(List continued on next page.)

OTHER PUBLICATIONS

U.S. patent application Ser. No. 09/821,609, Inoue et al., filed Mar. 29, 2001.
U.S. patent application Ser. No. 09/827,597, Inoue et al., filed Apr. 5, 2001.
U.S. patent application Ser. No. 09/838,017, Inoue et al., filed Apr. 19, 2001.
U.S. patent application Ser. No. 09/864,473, Nakata et al., filed May 24, 2001.

*Primary Examiner*—Deborah Yee

(57) ABSTRACT

The method for manufacturing steel sheet comprises the steps of: rough-rolling to form a sheet bar; finish-rolling the sheet bar to form a steel strip; applying primary cooling and secondary cooling to the finish-rolled steel strip; and coiling the secondary-cooled steel strip. The primary cooling is conducted at cooling speeds of 120° C./sec or more down to the temperatures of from 500 to 800° C. The secondary cooling is conducted at cooling speeds of less than 60° C./sec.

24 Claims, 3 Drawing Sheets

FOREIGN PATENT DOCUMENTS

| | | | | | |
|---|---|---|---|---|---|
| JP | 5-112831 | A | | 5/1993 | |
| JP | 6-248340 | A | | 9/1994 | |
| JP | 406264184 | A | * | 9/1994 | ..... C22C/38/00 |
| JP | 406336637 | A | * | 12/1994 | ..... C22C/38/00 |
| JP | 7-54051 | A | | 2/1995 | |
| JP | 7-56053 | B2 | | 6/1995 | |
| JP | 2555436 | B2 | | 9/1996 | |
| JP | 9-143570 | A | | 6/1997 | |
| JP | 9-241742 | A | | 9/1997 | |
| JP | 10-36917 | A | | 2/1998 | |
| JP | 11-131137 | A | | 5/1999 | |
| JP | 411343521 | A | * | 10/1999 | ..... C21D/9/48 |

* cited by examiner

STEEL SHEET AND METHOD FOR MANUFACTURING THE SAME

This application is a continuation application of International application PCT/JP00/06639 (not published in English) filed Sep. 27, 2000.

FIELD OF THE INVENTION

The present invention relates to a steel sheet such as hot-rolled steel sheets and cold-rolled steel sheets, and to a method for manufacturing the same.

BACKGROUND OF THE INVENTION

Steel sheets such as hot-rolled steel sheets and cold-rolled steel sheets are used in wide fields including automobiles, household electric appliances, and industrial machines. Since these steel sheets are subjected to some processing before use, they are requested to have various kinds of workability.

Recently, the request of manufacturers of automobiles, household electric appliances, industrial machines, and the like relating to rationalization becomes severer than ever, particularly in the request for improvement in production yield. To cope with the requirement, the materials thereof are requested to have particularly high homogeneity and high workability level.

Regarding the workability requested to the hot-rolled steel sheets and cold-rolled steel sheets, high tension materials (high tensile strength hot-rolled steel sheets) having strengths of 340 MPa or higher class and for the uses other than deep drawing, for example, are required to have high stretch flanging performance during burring. The cold-rolled steel sheets having strengths of 440 MPa or lower and for the drawing uses are requested to have high r value and high breaking elongation.

In recent years, the quality requirement of the consumers to the steel sheets has continuously been increasing, so that not only further improvement in the above-described workability but also homogeneity in mechanical properties in coiled products are strongly requested.

Responding to these requirements of consumers, several measures have been studied. For example, in view of the homogeneity of material quality, JP-A-9-241742, (the term "JP-A" referred herein signifies "Unexamined Japanese Patent Publication"), discloses a method for improving the homogeneity of mechanical properties in a hot-rolled coil by adopting continuous hot-rolling. The method is a technology that uses a process of continuous hot-rolling to improve the material quality of the rolled steel sheet at front end thereof and at rear end thereof, and to eliminate the dispersion in material quality within a coil.

As for the improvement in workability of high tension materials, JP-B-61-15929 and JP-B-63-67524, (the term "JP-B-" referred herein signifies "Examined Japanese Patent Publication"), disclose a method to improve the workability of high tension hot-rolled steel sheet by controlling the cooling speed after the hot-rolling and controlling the coiling temperature.

For the improvement in workability of IF steels (Interstitial-Free Steels), JP-A-5-112831 discloses a method to apply strong drafting during hot-rolling and to apply rapid cooling. The technology intends to improve the r value of cold-rolled steel sheet by applying final reduction in thickness of hot-rolling to 30% or more and by applying rapid cooling immediately after completed the rolling, thus reducing the grain size in the hot-rolled steel sheet.

All the above-described technologies, however, could not obtain steel sheet that is superior in both the workability and the homogeneity in mechanical properties. For example, the material properties (determined at center portion of coil width) obtained by the technology described in JP-A-9-241742 aiming at elimination of dispersion of material quality in a coil gave variations of tensile strength (TS) in an approximate range of from 4.5 to 6.3 kg/mm$^2$ for the steel sheets of 30 to 70 K class, which range is not satisfactory for users' requirement.

The technology described in JP-B-61-15929 aiming at the improvement in workability of high tension materials improves the balance of strength and ductility compared with conventional steel sheets, but fails to substantially solve the stretch flanging performance. Furthermore, the technology cannot improve the surface defects. Similarly, the high tension hot-rolled steel sheets manufactured by the method of JP-B-63-67524 cannot substantially solve the stretch flanging performance, though the breaking elongation and the toughness of steel sheets are improved.

Also the method described in JP-A-5-112831 aiming at the improvement in workability of IF steels cannot reduce the dispersion of material quantity to a satisfactory level. That is, according to the description of Examples of JP-A-5-112831, the average cooling speed immediately after the rolling, which average cooling speed is a feature of the invention, is in a range of from 90 to 105° C./sec during 1 second after starting the cooling, and from 65 to 80° C./sec during 3 seconds after starting the cooling. With that level of cooling speed, however, it was found that, under the hot-rolling condition in commercial apparatuses, the all grains in the steel sheet, particularly those in rolling top portion, cannot be refined.

The cause is presumably that the cooling cannot be started immediately after completed the finish-rolling, and there needs a time to start cooling. Since the cooling unit cannot be installed at directly adjacent to the exit of the final rolling stand owing to the necessity of installing finish thermometer and instruments to the exit of the final stand of finish-rolling mill, the cooling cannot be performed within, for example, 0.1 second after the completion of the finish-rolling. Particularly at the rolling top portion, high speed travel is not available and the rolling speed is slow, which results in long time before starting the cooling. Thus, the cooling at a cooling speed described in the patent disclosure cannot prevent the formation of coarse austenitic grains.

As described above, the top portion of the steel strip after the hot-rolling is difficult to be rapidly cooled, thus the grains cannot be fully reduced in their size, which fails to obtain superior mechanical properties and homogeneity thereof. Increased reduction in thickness in the final pass of hot-rolling is favorable for reducing the size of austenitic grains. However, increase of the reduction in thickness to 30% or more as in the technology described in JP-A-5-112831 is difficult to be actually implemented because the insufficient shape of steel sheet likely occurs.

The automobile industry has a strong need of weight reduction. Accordingly, the use rate of high strength steel sheets has been increased. To this point, the high tension materials are inferior in workability to the mild materials of 270 MPa class, thus there occur problems of production yield (cracks generated during press-working) and of quality dispersion. Consequently, the improvement in workability which is a basic characteristic of material quality is requested.

Regarding the workability, high tension materials having 340 MPa or higher tensile strength, for example, are requested for hot-rolled steel sheets and cold-rolled steel sheets to have high stretch flanging performance during burring. In addition, in recent years, the automobile application is requested to satisfy the collision safety as one of the critical characteristics, thus the steel sheets are requested to have excellent shock resistance (high shock absorption energy as an evaluation item of collision safety).

As for the improvement in workability of high tension materials, there is a prior art, Japanese Patent No. 2555436. According to the disclosure of the patent, a Ti base precipitation hardening steel is processed at cooling speeds of from 30 to 150° C./sec after the finish-rolling, at coiling temperatures of from 250 to 540° C., thus improving the stretch flanging performance of high tension steels of 50 to 60 K class utilizing the formed (ferrite+bainite) structure. However, the cooling speeds of from 30 to 150° C./sec after the finish-rolling cannot be said to substantially improve the stretch flanging performance, and, there is a problem of low breaking elongation owing to the low temperature level of coiling.

JP-B-7-56053 discloses a method to improve the stretch flanging performance of hot dip zinc-coated steel sheets as the substrate of hot-rolling sheets using (ferrite+pearlite) steels of 45 to 50 K class applying cooling speeds of 10° C./sec or more (Examples gave max. 95° C./sec) after the hot-rolling finishing. The cooling speed is, however, 95° C./sec at the maximum, and substantial improvement in the stretch flanging performance cannot be attained.

JP-A-4-88125 discloses a method to improve the stretch flanging performance of the high tensile materials of 50 to 70 K class using (ferrite+pearlite) steels with the addition of 0.0005 to 0.0050% Ca, applying hot-rolling at high temperatures of ($Ar_3$ transformation point +60 to 950° C.), and applying cooling within 3 seconds after the hot-rolling at cooling speeds of 50° C./sec or more, preferably 150° C./sec or less, then the cooling is stopped at temperatures of from 410 to 620° C. depending on the composition of the steel, followed by air cooling and coiling at 350 to 500° C. of coiling temperatures. Since, however, slight amount of addition of Ca requires an RH degassing step in the steel making stage, the steel making cost increases. Furthermore, even with the cooling condition after the hot-rolling, which cooling is a feature of the technology, the stretch flanging performance cannot be drastically improved. In addition, low coiling temperature results in low breaking elongation.

As described above, all these prior art technologies cannot attain satisfactory characteristics of stretch flanging performance and breaking elongation, and furthermore, they did not describe the improvement in the shock resistance.

As for the manufacturing of high tension steel sheets, there are methods to secure strength without adding large amount of alloying components: the method to strengthen the cooling after rolling; and the method to reduce grain size. The latter method particularly improves not only the strength but also the toughness, so that there are many proposals of the method, including JP-A-58-123823.

JP-A-61-73829 discloses a method that combines the method to strengthen the cooling after rolling with the method to reduce grain size, and the feature of the method is to apply rapid cooling to the steel sheet, which was once prepared to fine microstructure under an adjustment of rolling condition, for further reducing the grain size. That is, the rapid cooling is given to a state that slight amount of ferritic grains were generated during or immediately after the rolling, thus to finely divide the transformed structure using the ferrite to create very fine microstructure, which gives steel sheet having high strength and high toughness.

The method, however, absolutely requires the precipitation of ferrite during or immediately after the rolling owing to the low temperature rolling. Therefore, there are problems of, when the rolling finishing temperature and the temperature to stop cooling varied in the rolling width direction or in the rolling longitudinal direction, the strength varies even in the same composition steels and in a coil, which fails to attain specified strength.

As described above, since the prior art intends to refine the grains by rolling followed by rapid cooling the microscopic structure of the steel sheets to secure high strength and high toughness. Owing to the method, the prior art likely induces unstable characteristics under the variations in manufacturing conditions.

DISCLOSURE OF THE INVENTION

First, it is an object of the present invention to provide a method for manufacturing steel sheet that is applicable for press-working requiring strict dimensional accuracy, provides superior workability including stretch flanging performance, gives uniform mechanical properties and various levels of characteristics, and gives excellent sheet shape property.

To attain the object, the present invention provides a method for manufacturing steel sheet comprising the steps of: forming a sheet bar; forming a steel strip; applying primary cooling and secondary cooling to the steel strip; and coiling the cooled steel strip.

The step of forming the sheet bar comprises rough-rolling a continuously cast slab containing 0.8% or less C by weight.

The step of forming the steel strip comprises finish-rolling the sheet bar at finishing temperatures of not less than ($Ar_3$ transformation point −20° C.).

The step of cooling the steel strip comprises cooling the finish-rolled steel strip at cooling speeds of higher than 120° C./sec down to temperatures of from 500 to 800° C.

The step of coiling the cooled steel strip comprises coiling the secondary-cooled steel strip at temperatures of from 400 to 750° C.

In the method for manufacturing steel sheet, when a sheet bar is formed by rough-rolling a continuously cast slab containing more than 0.8% and not more than 1% C by weight, the sheet bar is finish-rolled at finishing temperatures of not less than (Acm transformation point −20° C.).

Secondly, it is an object of the present invention to provide a method for manufacturing steel sheet that induces less failures in forming to a product shape, is possible to conduct product layout on a coil at high yield, has superior workability of stretch flanging performance and breaking elongation, has high shock resistance, and gives excellent tensile strength as high as 340 MPa or more.

To attain the object, the present invention provides a method for manufacturing steel sheet comprising the steps of: forming a slab; forming a hot-rolled steel sheet; applying primary cooling and secondary cooling to the hot-rolled steel sheet; and coiling the cooled steel sheet.

The step of forming the slab comprises continuous casting to give treatment for reducing segregation to manufacture the slab consisting essentially of 0.05 to 0.14% C, 0.5% or less Si, 0.5 to 2.5% Mn, 0.05% or less P, 0.1% or less S, 0.005% or less O, and less than 0.0005% Ca, by weight.

The step of forming the hot-rolled steel sheet comprises hot-rolling the slab at finishing temperature of finish-rolling not less than $Ar_3$ transformation point.

The primary cooling step comprises cooling the hot-rolled steel sheet starting the primary cooling within 2 seconds after the hot-rolling to temperatures of from 600 to 750° C. at cooling speeds of from 100 to 2,000° C./sec.

The secondary cooling step comprises cooling the primary-cooled steel sheet starting the secondary cooling to the above-described temperature range at cooling speeds of less than 50° C./sec. The secondary-cooled steel sheet is coiled at temperatures of from 450 to 650° C.

Thirdly, it is an object of the present invention to provide a method for manufacturing steel sheet that provides wanted strength characteristics stably.

To attain the object, the present invention provides a method for manufacturing steel sheet comprising hot-rolling step and cooling step.

The step of hot-rolling comprises hot-rolling a steel consisting essentially of 0.03 to 0.12% C., 1% or less Si, 5 to 2% Mn, 0.02% or less P, 0.01% or less S, at least one element selected from the group consisting of 0.005 to 0.1% Nb, 0.005 to 0.1% V, and 0.005 to 0.1% Ti, by weight, at temperatures of 1,070° C. or below to accumulated reductions in thickness of 30% or more.

The step of hot-rolling may be carried out on a steel consisting essentially of 0.03 to 0.12% C, 1% or less Si, 0.5 to 2% Mn, 0.02% or less P, 0.01% or less S, and 0.05 to 0.5% Mo, by weight, at temperatures of 1,070° C. or below to accumulated reductions in thickness of 30% or more.

The step of cooling comprises cooling steel sheet within 6 seconds after the completion of the rolling to temperatures higher than 500° C. and not higher than 700° C. at average cooling speeds of not less than 80° C./sec.

PREFERRED EMBODIMENT FOR CARRYING OUT THE INVENTION

PREFERRED EMBODIMENT 1

Figure 1:
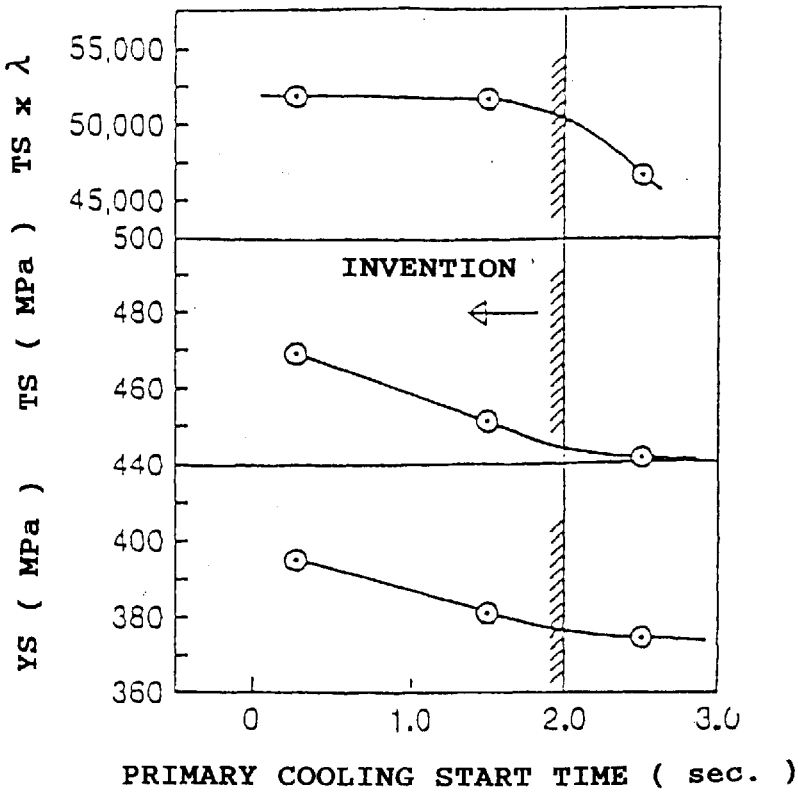
FIG. 1 shows the influence of the time to start the primary cooling on the mechanical properties according to the Preferred embodiment 2.

The method for manufacturing steel sheet according to the Preferred embodiment 1 comprises the steps of: forming a sheet bar by rough-rolling a continuous cast slab containing 0.8% or less C by weight; forming a steel strip by finish-rolling the sheet bar at finishing temperatures of finish-rolling of not less than ($Ar_3$ transformation point −20° C.); rapid cooling the steel strip after the finish-rolling down to temperatures of from 500 to 800° C. at cooling speeds of higher than 120° C./sec; and coiling the steel strip after the rapid cooling at coiling temperatures of from 400 to 750° C.

In the manufacturing method, the continuously cast slab may be prepared by continuously casting a steel consisting essentially of 0.8% or less C, 2.5% or less Si, and 3.0% or less Mn, by weight. Furthermore, the continuously cast slab may be prepared by continuously casting a steel consisting essentially of 0.8% or less C, 2.5% or less Si, 3.0% or less Mn, and 0.01 to 0.2% at least one element selected from the group consisting of Ti, Nb, V, Mo, Zr, and Cr, by weight. Furthermore, the continuously cast slab may be prepared by continuously casting a steel consisting essentially of 0.8% or less C, 2.5% or less Si, 3.0% or less Mn, and 0.005% or less at least one of Ca and B, by weight.

In these manufacturing methods, the continuously cast slab may be prepared by continuously casting a steel consisting essentially of 0.8% or less C, 2.5% or less Si, 3.0% or less Mn, 0.01 to 0.2% at least one element selected from the group consisting of Ti, Nb, V, Mo, Zr, and Cr, and 0.005% or less at least one of Ca and B, by weight.

In these manufacturing methods, the C content may be specified to a range of from more than 0.8% and not more than 1.0% by weight, instead of 0.8% or less, and the finishing temperature may be specified to (Acm transformation point −20° C.) instead of ($Ar_3$ transformation point −20° C.), while adopting the same conditions for other variables.

The above-described aspects of the invention have been derived during the keen studies to solve the above-described problems. In the course of the studies, the inventors of the present invention found that the workability of steel sheets and the homogeneity of mechanical properties thereof are significantly influenced by the time between immediately after the rolling and the start of cooling and by the cooling speed. After investigating these variables, the inventors of the present invention have successfully manufactured steel sheet having excellent workability and homogeneous mechanical properties, allowing high yield product layout on a coil, from the standpoint of use conditions at manufacturers of automobiles, household electric appliances, industrial machines, and the like. The detail of the manufacturing method according to the present invention is described in the following. First, the chemical composition of steel is described.

C: 1% or less (by weight: hereinafter the same unit is applied)

Carbon is an additive element to ensure the strength of steel. Excessive addition, however, results in significant degradation in workability. That is, more than 1% C content induces degradation in workability. Accordingly, the C content is specified to 1% or less.

Si: 2.5% or less

Silicon is an element to strengthen solid solution. If, however, the Si content exceeds 2.5%, the surface properties degrade. Consequently, the Si content is preferably 2.5% or less.

Mn: 3% or less

Manganese improves toughness of the steel sheet and has function to strengthen solid solution. However, Mn is an element that gives bad influence on workability. If the Mn content exceeds 3%, the strength increases to significantly degrade the workability. Therefore, the Mn content is preferably 3% or less.

P: 0.2% or less

Phosphorus is an element that has a function to strengthen solid solution. If, however, the P content exceeds 0.2%, grain boundary brittleness caused from grain boundary segregation likely occurs. Accordingly, the P content is preferably 0.2% or less.

S: 0.05% or less

Sulfur is an impurity element, and the S content is preferably minimized. If the S content exceeds 0.05%, fine sulfide precipitation increases to degrade the workability. Consequently, the S content is preferably 0.05% or less.

N: 0.02% or less

Less amount of N reduces further the necessary adding amount of carbo-nitride forming elements, which are described later, to improve economy. If the N content exceeds 0.02%, the degradation in workability of steel sheet unavoidably occurs even when carbo-nitride forming elements are added to fix N. Therefore, the N content is preferably 0.02% or less.

O: 0.005% or less

Oxygen content is required to be controlled to suppress crack generation on the surface of slab or below the surface layer of slab during continuous casting. If the O content exceeds 0.005%, the crack generation on slab becomes significant, and the workability which is an aim of the present invention also degrades. Accordingly, the O content is preferably 0.005% or less.

At least one element selected from the group consisting of Ti, Nb, V, Mo, Zr and Cr: 0.01 to 0.2%

Adding to the above-described chemical components, necessary amounts of Ti, Nb, V, Mo, Zr, Cr are added to adjust the strength or to improve the non-aging effect (and to improve the deep drawing performance) utilizing the reduction in solid solution C and N resulted from the formation of carbo-nitrides. The sum of added these elements less than 0.01% gives no effect, and more than 0.2% degrades the workability such as ductility and deep drawing performance. Consequently, if Ti, Nb, V, Mo, Zr, Cr are added, the sum of these elements are specified to a range of from 0.01 to 0.2%.

At least one element element selected from the group consisting of Ca and B: 0.005% or less According to the present invention, Ca and B are effective elements to improve the workability of steel sheet, so these elements are preferably to be added. If, however, the sum of the Ca and B contents exceeds 0.005%, the deep drawing performance is degraded. Therefore, if Ca and/or B are added, the sum of the added contents is specified to 0.005% or less.

Next, the manufacturing conditions according to the present invention are described below.

Finishing temperature (for the case of C≦0.8%): ($Ar_3$ transformation point −20° C.) or above When the C content is 0.8% or less, if the finishing temperature is below the ($Ar_3$ transformation point −20° C.), the ferrite transformation proceeds in a part of the steel microstructure, resulting in working on the ferritic grains, which leads to unfavorable material quality such as enhanced nonhomogeneous material quality and intraplane anisotropy. Therefore, according to the present invention, when the C content is 0.8% or less, the finish-rolling is applied at finishing temperatures of ($Ar_3$ transformation point −20° C.) or above. The finish-rolling assures the homogeneous structure and the reduced grain size in succeeding steps, thus improves the workability such as the balance of strength and ductility, the stretch flanging performance, and increases the r value in a cold-rolled steel sheet.

Finishing temperature (for the case of C>0.8%): (Acm transformation point −20° C.) or above When the C content exceeds 0.8%, if the finishing temperature is below the (Acm transformation point −20° C.), the cementite which is precipitated at austenitic grain boundaries increases to fail to form homogeneous pearlite structure, which results in nonhomogeneous microstructure. Thus, according to the present invention, when the C content exceeds 0.8%, the finish-rolling is applied at finishing temperature of ($Ar_3$ transformation point −20° C.) or above. The finish-rolling assures the homogeneous microstructure and the reduced grain size in succeeding steps, thus improves the workability such as the quenching performance, the spheroidizing rate in cold-rolled steel sheet, and the stretch flanging performance.

Cooling after rolled: rapid cooling at cooling speed>120° C./sec

According to the present invention, rapid cooling after rolled is necessary to establish fine structure of ferritic grains, pearlite and the like after the transformation and to uniformize the material quality. If the cooling is gradual cooling, the microstructure becomes coarse one, and in a high C steel, homogeneous pearlite structure cannot be attained to result in nonhomogeneous microstructure. If the cooling speed is 120° C./sec or less, the ferritic grains and the structure of pearlite and the like generated from transformation become coarse, and in a hypereutectoid steel, cementite precipitates to result in nonhomogeneous microstructure.

End temperature of cooling: 500 to 800° C.

If rapid cooling is given down to below 500° C., the difference (margin) between the cooling temperature and the coiling temperature becomes less, which makes temperature homogenization difficult. Furthermore, additional cooling unit for the rapid cooling becomes necessary, which increases the investment cost. To the contrary, if the end temperature of cooling exceeds 800° C., only a part of the microstructure is transformed to give nonhomogeneous one, thus the microstructure becomes coarse during the cooling (slow cooling) accompanied with the temperature adjustment during the succeeding coiling step.

Accordingly, after the rolling, when the steel strip is subjected to primary cooling at cooling speeds of higher than 120° C./sec down to the temperatures of from 500 to 800° C., the ferritic grains and the precipitates of pearlite and the like become fine in their size after the transformation, which improves the workability. The upper limit of the cooling speed is not specifically specified. From the viewpoint of industrial applicability, however, the upper limit of the cooling speed is 2,000° C./sec.

Coiling temperature: 400 to 750° C.

After the secondary cooling, the steel strip is required to be coiled at coiling temperatures of from 400 to 750° C. The reason is that less than 400° C. of coiling temperature induces the formation of low temperature transformation phase, and that above 750° C. of coiling temperature induces formation of coarse microstructure of grains and the like to degrade the workability.

The basic manufacturing conditions according to the present invention are described above. The following-described manufacturing conditions may further be applied, at need.

Treatment in the course of from continuous casting to rough-rolling: direct rolling or warm feeding The continuously cast slab may be roughly-rolled either by direct hot-rolling or by reheating, before cooling to room temperature, to temperatures of 1,200° C. or below by feeding at warm state into a heating furnace. According to the present invention, the continuously cast slab is not cooled to room temperature but started the rough-rolling with direct-rolling in as-cast state, or is reheated to temperatures of 1,200° C. or below, followed by starting rough-rolling. As a result, the temperature of slab before rolling becomes uniform and the mechanical properties in a coil becomes further homogeneous.

Treatment in the course of from immediately before the finish-rolling to during the rolling: induction heating The material to be rolled may be heated by an induction heating unit immediately before the finish-rolling or during the finish-rolling. According to the present invention, the temperature of the material during rolling becomes more uniform and the mechanical properties in a coil become more homogeneous.

Time to start the rapid cooling: more than 0.1 second and less than 1.0 second

After the finish-rolling, the rapid cooling can start within a period ranging from more than 0.1 second and less than 1.0 second. According to the present invention, the ferritic grains and the precipitates of pearlite and the like are refined after the transformation, which further improves the workability.

Treatment after coiling: cold-rolling to annealing

The steel sheet manufactured by the above-described method may further be subjected to cold-rolling and annealing. According to the present invention, the material properties and structure of the hot-rolled coil are homogeneous, the annealing after the cold-rolling provides a cold-rolled steel sheet that has excellent workability and homogeneity of mechanical properties.

Thus, according to the present invention, the reduction in variations of temperature in a coil allows to manufacture a steel sheet in which the variations (maximum and minimum values) of tensile strength of the hot-rolled steel strip in the width direction and in the longitudinal direction thereof are within ±8% of the average of the tensile strength in a coil. The steel sheet having that small variations gives small variations of press-workability (such as spring back during bending) in a coil. That type of steel sheet contributes to the product yield and shape accuracy after the press-working at users' shops. That is, the steel sheet has excellent performance as the material.

On carrying out the present invention, the steel composition is not specifically limited, and common existing compositions of hot-rolled steel sheets and cold-rolled steel sheet that have various characteristics may be applied. That is, simple carbon steel sheets or steel sheets containing special elements such as Ti, Nb, V, Mo, Zr, Ca, B are also applicable. According to the present invention, the addition of 0.02 to 2% Cu and the addition of 0.01% or less Sn are allowable. Within that range of Cu and Sn contents, these elements do not degrade the effect of the present invention.

When a continuously cast slab is not cooled to room temperature but started rough-rolling after heated to 1,200° C. or lower temperature, the temperature of slab before the rolling can be uniformized, thus the mechanical properties in a coil can further be homogenized. After the continuously cast slab is roughly-rolled, when the sheet bar immediately before the finish-rolling is, or when the material during the finish-rolling is heated by an induction heating unit, the temperature of the material during rolling can further be uniformized, and the mechanical properties in a coil can further be homogenized.

In the finish-rolling, the reduction in thickness in the final pass is preferably set to 8% or more and less than 30%. The reason is that full reduction of austenitic grain size preferably requires 8% or higher reduction in thickness, and that sustaining good shape of steel sheet preferably requires less than 30% reduction in thickness. From the point of size reduction in the hot-rolled steel sheet, it is preferable that the reduction in thickness at each rolling pass is set to higher than 10%.

As for the finishing temperature, when the C content is 0.8% or less, if the finish-rolling is conducted at temperatures of from ($Ar_3$ transformation point −20° C.) to ($Ar_3$ transformation point +50° C.), the grains immediately after the finish-rolling, or before the runout table cooling, can be refined. By adopting the finishing temperature of ($Ar_3$ transformation point +50° C.) or less, the formation of coarse austenitic grains is prevented, and the reduction in ferritic grain size after rolling becomes easy. As a result, the refinement of grains in succeeding steps can be attained, thus improving the workability such as the balance of strength and ductility, the stretch flanging performance, and high r value in cold-rolled steel sheet.

When the C content exceeds 0.8%, if the finish-rolling is given at temperatures of from (Acm transformation point −20° C.) to (Acm transformation point +100° C.), while adopting the other conditions same as those in the case of 0.8% or less C, the steel sheet having excellent workability and homogeneous mechanical properties can be obtained. By adopting the finishing temperature to (Acm transformation point +100° C.) or below, the formation of coarse austenitic grains is prevented and the formation of fine pearlite colony after the rolling can be attained.

When the finishing temperature differs depending on the positions on a material being rolled in width direction and in longitudinal direction, and when the difference therebetween becomes significant, the structure of steel strip becomes nonhomogeneous. Thus, the difference in finishing temperature is preferably maintained to a small level. If the finish-rolling is conducted so as the finishing temperature difference in a material being rolled to fall in 50° C. range, the microstructure of steel strip immediately after the finish-rolling becomes homogeneous, and the homogeneity of the mechanical properties after coiled is assured. As a result, the difference in microstructure and material properties of final products can be neglected. Therefore, the difference in finishing temperature in a material being rolled is preferably 50° C. or less.

After the rolling, to establish fine microstructure of ferritic grains and pearlite and the like and to establish homogeneous material quality, the cooling after the rolling is preferably in combination of rapid cooling and slow cooling. By applying slow cooling after the rapid cooling, the local irregularity of end temperature of cooling is reduced, and the variations in absolute values of end temperature of cooling become less, so that the variations in material quality level is diminished. Above-described rapid cooling and slow cooling are hereinafter referred to the primary cooling and the secondary cooling, respectively.

Primary cooling to temperatures of from 500 to 800° C. at cooling speeds exceeding 120° C./sec improves the workability through the refinement of ferritic grains and of pearlite structure after the transformation. At that moment, extremely superior workability is attained by applying the cooling at cooling speeds of 200° C./sec or more, more preferably of 400° C./sec or more, from the viewpoint of reduction in size of ferritic grains and of pearlite structure. Although the upper limit of the cooling speed is not specifically specified, industrial application has a limit of approximately 2,000° C./sec.

To reduce the dispersion of material properties of hot-rolled steel strip to further preferable level, it is preferred for the temperature to stop the rapid cooling to regulate within the range of the present invention and for the temperature variations (maximum value-minimum value) in the width direction and in the longitudinal direction of coil after the rapid cooling to regulate within 60° C.

More preferably, by regulating the variations of tensile strength to within ±4%, the above-described performance at users site can be significantly improved. In that case, by regulating the variations of temperature to stop the rapid cooling to within 40° C., the variations in the material quality can be minimized.

To further reduce the variations of tensile strength to within ±2%, the above-given variations of temperature to stop the rapid cooling may be regulated to within 20° C. The reduction in variations of material quality can be determined from the relation between the variations of these temperatures and the tensile strength. The temperature in the coil width direction according to the present invention covers the range of coil width except for the 30 mm area from each of the edges thereof.

As for the performance of the rapid cooling (primary cooling), the variations in temperature after the rapid cooling can be reduced by applying cooling with a heat transfer coefficient of 2,000 kcal/m$^2$h° C. Preferred heat transfer coefficients to reduce the variations of temperature are 5,000 kcal/m$^2$h° C. or more, further preferably 8,000 kcal/m$^2$h° C. or more.

For the primary cooling, if the cooling starts within a period of from more than 0.1 second to less than 1.0 second after the finish-rolling, the post-transformation ferritic grains and precipitates such as pearlite can be refined, thus the workability can further be improved. To attain more preferable level of dispersion of material quality in hot-rolled steel strip, the time to start cooling is preferably longer than 0.5 second after the finish-rolling.

After the primary cooling, preferably slow cooling (secondary cooling) is applied for adjusting the coiling temperature. In particular, when the cooling speed of the secondary cooling is less than 60° C./sec, accurate temperature control is available, thus the end temperature of cooling, or the temperature of coiling, becomes uniform. As a result, the structure of coil after the coiling becomes further homogeneous, so that it is preferable to give the secondary cooling to the steel strip at cooling speeds of less than 60° C./sec for homogenizing the mechanical properties in a coil.

After the secondary cooling, the steel strip is necessary to be coiled at temperatures of from 400 to 750° C. The reason is that the coiling temperatures of less than 400° C. induces the formation of low temperature transformed phase, and that the coiling temperature of higher than 750° C. induces formation of coarse structure of grains or the like to degrade the workability. As for the coiling temperature of high C materials, the coiling temperature is preferred to be applied at 450° C. or more to prevent the formation of low temperature transformed phase. From the viewpoint of homogenization of the material quality of final products, it is preferred to regulate the difference in coiling temperature in a coil to 80° C. or less.

The present invention can also be applied to the direct rolling process in which a continuously cast slab is directly hot-rolled without passing through a heating furnace. The present invention is also effective to the continuous rolling process that uses a coil box and the like. When the material being rolled is heated by an induction heating unit immediately before the finish-rolling or during the finish-rolling, the present invention is also effective when edge heating is applied.

Annealing thus obtained hot-rolled coil after the cold-rolled provides cold-rolled steel sheet having both excellent workability and excellent homogenization of mechanical properties. In that case, the annealing is preferably applied by continuous annealing to assure homogeneity of the mechanical properties.

EXAMPLE 1

Steels Nos. 1 through 7 having the chemical compositions given in Table 1 were prepared by melting. All these steels have the chemical compositions within the range of the present invention. The steels were rolled under the hot-rolling conditions given in Table 2 to form respective hot-rolled coils Nos. 1 through 14, each having a thickness of 3 mm. The heat transfer coefficients in the rapid cooling (primary cooling) in Example 1 were 3,000 to 4,000 kcal/m$^2$h° C.

Tension testing specimens were prepared by cutting at 5 positions on each of the hot-rolled coil in the longitudinal direction thereof. On each specimen, average tensile strength (TS), total elongation (E1), dispersion in tensile strength (ΔTS), and dispersion in total elongation (ΔE1) were determined. For a part of the hot-rolled coils, bore expanding rate (λ) and dispersion in bore expanding rate (Δλ) were determined. Furthermore, for the hot-rolled coils Nos. 4 through 7 and Nos. 11 through 13, cold-rolling was applied after pickling to a sheet thickness of 0.8 mm, followed by applying continuous annealing, then the r value was determined to evaluate the deep drawing performance. Table 3 shows the result of determination of these mechanical properties of the hot-rolled coils and the cold-rolled and annealed sheets.

As clearly seen by comparing the steel sheets Nos. 1 through 8 of the Examples of the present invention with the steel sheets Nos. 9 through 14 of the Comparative Examples, having respective chemical compositions, the dispersions of mechanical properties, ΔTS, ΔE1, and Δλ, were smaller in the Examples of the present invention than those in the Comparative Examples, for all the chemical compositions tested. To the contrary, the steel sheets Nos. 9 through 14 of the Comparative Examples failed to satisfy one or more of the manufacturing conditions specified by the present invention, giving inferior homogeneity in the mechanical properties or inferior workability to the steel sheets Nos. 1 through 8 of the Examples of the present invention having the same chemical composition to the Comparative Example steels.

EXAMPLE 2

Steels Nos. 1 through 7 having the chemical compositions given in Table 1 were rolled under the hot-rolling conditions given in Table 4 to form respective hot-rolled coils Nos. 15 through 28, each having a thickness of 3 mm. The heat transfer coefficients in the primary cooling were 12,000 kcal/m$^2$h° C. for the steels Nos. 15 through 22 of the Examples of the present invention, and 1,000 kcal/m$^2$h° C. for the steels Nos. 23 through 28 of the Comparative Examples.

Similar with the Example 1, the dispersion in mechanical properties in the width direction and in the longitudinal direction of these hot-rolled coils were determined. Furthermore, the hot-rolled coils Nos. 18 through 22 and Nos. 26 through 28 were cold-rolled after the pickling to a thickness of 0.8 mm, followed by applying continuous annealing, then the r value was determined to evaluate the deep drawing performance. Table 5 shows the result of determination of these mechanical properties of the hot-rolled coils and the cold-rolled and annealed sheets.

In the table, ΔTS and ΔE1 indicate the half value of the difference between the maximum value and the minimum value of TS and E1, respectively. To determine the tensile characteristics, specimens were sampled from the coil excluding the portions of 30 mm from each edge in the coil width and of 5 m from each end in the coil length. The average of all the determined values was adopted as the intra-coil average.

As clearly seen by comparing the steel sheets Nos. 15 through 22 of the Examples of the present invention with the steel sheets Nos. 23 through 28 of the Comparative Examples, having respective chemical compositions, the dispersions of mechanical properties, ΔTS and ΔE1, were smaller in the Examples of the present invention than those in the Comparative Examples, for all the chemical compositions tested. To the contrary, the steel sheets Nos. 23 through 28 of the Comparative Examples failed to satisfy one or more of the manufacturing conditions specified by the present invention, giving inferior homogeneity in the mechanical properties or inferior workability to the steel sheets Nos. 15 through 22 of the Examples of the present invention having the same chemical composition to the Comparative Example steels.

According to the present invention, the variations of temperature to stop the rapid cooling (primary cooling) in a coil are smaller than those in the conventional laminar cooling in prior art, and the variations in mechanical properties are reduced to further preferable level. The cooling method according to the present invention is the perforated ejection type providing high heat transfer coefficient.

As described above, the present invention allows to manufacture steel sheet that has excellent homogeneity of mechanical properties in a coil, giving high E1 and λ values of hot-rolled coil and high r value after cold-rolled and annealed, and providing excellent workability.

TABLE 1

Weight %

| Steel No. | C | Si | Mn | S | P | O | N | Ti | Nb | V | Mo | Zr | B | Ca |
|---|---|---|---|---|---|---|---|---|---|---|---|---|---|---|
| 1 | 0.850 | 0.24 | 0.47 | 0.003 | 0.017 | 0.0020 | 0.0025 | — | — | — | — | 0.005 | — | — |
| 2 | 0.061 | 0.03 | 0.71 | 0.001 | 0.012 | 0.0021 | 0.0020 | — | — | 0.010 | — | — | — | — |
| 3 | 0.166 | 0.01 | 0.70 | 0.004 | 0.016 | 0.0022 | 0.0031 | — | — | — | — | — | — | 0.002 |
| 4 | 0.021 | 0.01 | 0.22 | 0.008 | 0.016 | 0.0018 | 0.0026 | — | — | — | — | — | 0.0025 | — |
| 5 | 0.0020 | 0.02 | 0.21 | 0.005 | 0.010 | 0.0021 | 0.0014 | 0.035 | — | — | 0.010 | — | 0.0003 | — |
| 6 | 0.0015 | 0.25 | 0.65 | 0.008 | 0.050 | 0.0020 | 0.0020 | 0.031 | 0.015 | — | — | — | — | — |
| 7 | 0.0015 | 0.25 | 0.65 | 0.008 | 0.050 | 0.0020 | 0.0020 | 0.008 | 0.023 | — | — | — | — | — |

TABLE 2

| Steel sheet | Steel | Slab heat-treatment history | Finish final reduction in thickness (%) | End temperature of rolling (° C.) | Difference in end temperature of rolling (° C.) | Time to start the runout table cooling (sec) | Primary cooling speed (° C./sec) | End temperature of the primary cooling (° C.) | Secondary cooling speed (° C./sec) | Coiling temperature (° C.) | Remark |
|---|---|---|---|---|---|---|---|---|---|---|---|
| 1 | 1 | Casting, then heating to 1,250° C. | 10 | (Arcm + 40) ~ (Arcm + 60) | 20 | 1.3 | 200 | 650 | 15 | 600 ~ 625 | E |
| 2 | 2 | Casting, then hot direct rolling | 10 | (Ar3 + 20) ~ (Ar3 + 45) | 25 | 0.9 | 205 | 670 | 20 | 590 ~ 620 | E |
| 3 | 3 | Casting, then hot direct rolling | 15 | (Ar3 + 30) ~ (Ar3 + 50) | 20 | 0.5 | 160 | 680 | 25 | 570 ~ 600 | E |
| 4 | 4 | Casting, then heating to 1,200° C. | 15 | (Ar3 + 5) ~ (Ar3 + 20) | 15 | 0.3 | 200 | 680 | 10 | 605 ~ 625 | E |
| 5 | 5 | Casting, then heating to 1,200° C. | 15 | (Ar3 + 5) ~ (Ar3 + 15) | 10 | 0.2 | 210 | 690 | 20 | 630 ~ 650 | E |
| 6 | 6 | Casting, then heating to 1,200° C. | 15 | Ar3 ~ (Ar3 + 10) | 10 | 0.4 | 200 | 680 | 25 | 635 ~ 648 | E |
| 7 | 6 | Casting, then heating to 1,200° C. | 10 | Ar3 ~ (Ar3 + 10) | 10 | 1.2 | 200 | 680 | 25 | 630 ~ 645 | E |
| 8 | 7 | Casting, then heating to 1,200° C. | 10 | Ar3 ~ (Ar3 + 10) | 10 | 1.2 | 200 | 680 | 25 | 625 ~ 650 | E |

TABLE 2-continued

| Steel sheet | Steel | Slab heat-treatment history | Finish final reduction in thickness (%) | End temperature of rolling (° C.) | Difference in end temperature of rolling (° C.) | Time to start the runout table cooling (sec) | Primary cooling speed (° C./sec) | End temperature of the primary cooling (° C.) | Secondary cooling speed (° C./sec) | Coiling temperature (° C.) | Remark |
|---|---|---|---|---|---|---|---|---|---|---|---|
| 9 | 1 | Casting, then heating to 1,250° C. | 15 | (Arcm − 10) ~ (Arcm + 50) | 60 | 1.2 | 190 | 660 | 15 | 595 ~ 620 | C |
| 10 | 2 | Casting, then hot direct rolling | 15 | (Ar3 + 25) ~ (Ar3 + 40) | 15 | 0.8 | 200 | 700 | 65 | 585 ~ 610 | C |
| 11 | 3 | Casting, then hot direct rolling | 15 | (Ar3 + 25) ~ (Ar3 + 50) | 25 | 0.5 | 170 | 680 | 25 | 685 ~ 710 | C |
| 12 | 4 | Casting, then heating to 1,200° C. | 20 | Ar3 ~ (Ar3 + 20) | 20 | 0.3 | 180 | 690 | 60 | 600 ~ 615 | C |
| 13 | 5 | Casting, then heating to 1,200° C. | 35 | (Ar3 + 5) ~ (Ar3 + 15) | 10 | 0.2 | 80 | 700 | 50 | 620 ~ 643 | C |
| 14 | 6 | Casting, then heating to 1,200° C. | 15 | Ar3 ~ (Ar3 + 15) | 15 | 1.2 | 200 | 670 | 65 | 630 ~ 648 | C |

C: Comparative example
E: Example

TABLE 3

| Steel sheet No. | Steel No. | Mechanical properties of hot-rolled steel sheet TS(Mpa) | ΔTS(Mpa) | El(%) | ΔEl(%) | λ(%) | Δλ(%) | Shape of hot-rolled steel sheet | r value after cold-rolled and annealed | Remark |
|---|---|---|---|---|---|---|---|---|---|---|
| 1 | 1 | 1018 | 40 | 16 | 3 | — | — | Good | — | Example |
| 2 | 2 | 640 | 25 | 25 | 5 | 100 | 20 | Good | — | Example |
| 3 | 3 | 505 | 18 | 36 | 6 | 150 | 32 | Good | — | Example |
| 4 | 4 | 359 | 12 | 45 | 6 | — | — | Good | 1.6 | Example |
| 5 | 5 | 284 | 10 | 47 | 5 | — | — | Good | 2.7 | Example |
| 6 | 6 | 355 | 11 | 42 | 4 | — | — | Good | 2.7 | Example |
| 7 | 6 | 350 | 10 | 43 | 4 | — | — | Good | 2.5 | Example |
| 8 | 7 | 355 | 9 | 42 | 4 | — | — | Good | 2.6 | Example |
| 9 | 1 | 1015 | 70 | 15 | 6 | — | — | Good | — | Comparative example |
| 10 | 2 | 640 | 51 | 23 | 7 | 90 | 35 | Good | — | Comparative example |
| 11 | 3 | 457 | 26 | 30 | 9 | 95 | 36 | Good | — | Comparative example |
| 12 | 4 | 361 | 22 | 41 | 8 | — | — | Good | 1.3 | Comparative example |
| 13 | 5 | 280 | 11 | 46 | 6 | — | — | Bad (significant edge wave) | 2.2 | Comparative example |
| 14 | 6 | 349 | 21 | 42 | 6 | — | — | Good | 2.4 | Comparative example |

TABLE 4

| Steel sheet | Steel | Slab heat-treatment history | End temperature of rolling (° C.) | Difference in end temperature of rolling (° C.) | Time to start the runout table cooling (sec) | Primary cooling speed (° C./sec.) | End temperature of the primary cooling (° C.) | Secondary cooling speed (° C./sec) | Coiling temperature (° C.) | Remark |
|---|---|---|---|---|---|---|---|---|---|---|
| 15 | 1 | Casting, then heating to 1,250° C. | (Arcm + 45) ~ (Arcm + 60) | 15 | 1.3 | 430 | 635 ~ 662 | 20 | 600 ~ 620 | E |
| 16 | 2 | Casting, then hot direct rolling | (Ar3 + 20) ~ (Ar3 + 40) | 20 | 0.9 | 440 | 655 ~ 681 | 20 | 590 ~ 620 | E |
| 17 | 3 | Casting, then hot direct rolling | (Ar3 + 30) ~ (Ar3 + 45) | 15 | 0.6 | 440 | 665 ~ 693 | 30 | 575 ~ 600 | E |
| 18 | 4 | Casting, then heating to 1,200° C. | (Ar3 + 5) ~ (Ar3 + 20) | 15 | 0.6 | 435 | 665 ~ 690 | 10 | 605 ~ 625 | E |
| 19 | 5 | Casting, then heating to 1,200° C. | (Ar3 + 5) ~ (Ar3 + 20) | 15 | 0.6 | 420 | 678 ~ 702 | 25 | 635 ~ 650 | E |

TABLE 4-continued

| Steel sheet | Steel | Slab heat-treatment history | End temperature of rolling (° C.) | Difference in end temperature of rolling (° C.) | Time to start the runout table cooling (sec) | Primary cooling speed (° C./sec.) | End temperature of the primary cooling (° C.) | Secondary cooling speed (° C./sec) | Coiling temperature (° C.) | Remark |
|---|---|---|---|---|---|---|---|---|---|---|
| 20 | 6 | Casting, then heating to 1,200° C. | Ar3 ~ (Ar3 + 15) | 15 | 0.6 | 450 | 663 ~ 695 | 25 | 635 ~ 645 | E |
| 21 | 6 | Casting, then heating to 1,200° C. | Ar3 ~ (Ar3 + 10) | 10 | 1.2 | 430 | 667 ~ 696 | 20 | 625 ~ 645 | E |
| 22 | 7 | Casting, then heating to 1,200° C. | Ar3 ~ (Ar3 + 15) | 15 | 1.2 | 420 | 660 ~ 700 | 25 | 630 ~ 650 | E |
| 23 | 1 | Casting, then heating to 1,250° C. | (Arcm − 10) ~ (Arcm + 50) | 60 | 1.2 | 60 | 630 ~ 700 | 20 | 595 ~ 620 | C |
| 24 | 2 | Casting, then hot direct rolling | (Ar3 + 25) ~ (Ar3 + 40) | 15 | 0.8 | 50 | 651 ~ 734 | 65 | 585 ~ 620 | C |
| 25 | 3 | Casting, then hot direct rolling | (Ar3 + 25) ~ (Ar3 + 50) | 25 | 0.5 | 40 | 635 ~ 724 | 20 | 685 ~ 720 | C |
| 26 | 4 | Casting, then heating to 1,200° C. | Ar3 ~ (Ar3 + 20) | 20 | 0.3 | 50 | 645 ~ 721 | 60 | 600 ~ 625 | C |
| 27 | 5 | Casting, then heating to 1,200° C. | (Ar3 + 5) ~ (Ar3 + 15) | 10 | 0.2 | 50 | 657 ~ 730 | 45 | 620 ~ 653 | C |
| 28 | 6 | Casting, then heating to 1,200° C. | Ar3 ~ (Ar3 + 15) | 15 | 12 | 50 | 635 ~ 705 | 60 | 630 ~ 658 | C |

C: Comparative example
E: Example

TABLE 5

| Steel sheet No. | Steel No. | Mechanical properties of hot-rolled steel sheet TS (Mpa) | ΔTS (Mpa) | El(%) | ΔEl (%) | r value after cold-rolled and annealed | Remark |
|---|---|---|---|---|---|---|---|
| 15 | 1 | 1015 | 32 | 17 | 2 | — | Example |
| 16 | 2 | 632 | 17 | 26 | 4 | — | Example |
| 17 | 3 | 500 | 13 | 38 | 5 | — | Example |
| 18 | 4 | 354 | 8 | 45 | 5 | 1.7 | Example |
| 19 | 5 | 280 | 7 | 48 | 4 | 2.8 | Example |
| 20 | 6 | 352 | 6 | 43 | 2 | 2.7 | Example |
| 21 | 6 | 351 | 7 | 43 | 2 | 2.6 | Example |
| 22 | 7 | 353 | 8 | 43 | 2 | 2.7 | Example |
| 23 | 1 | 1014 | 90 | 13 | 6 | — | Comparative example |
| 24 | 2 | 641 | 55 | 23 | 6 | — | Comparative example |
| 25 | 3 | 458 | 41 | 30 | 8 | — | Comparative example |
| 26 | 4 | 360 | 32 | 40 | 7 | 1.3 | Comparative example |
| 27 | 5 | 281 | 25 | 43 | 7 | 2.1 | Comparative example |
| 28 | 6 | 340 | 31 | 41 | 6 | 2.2 | Comparative example |

PREFERRED EMBODIMENT 2

The inventors of the present invention carried out extensive studies to improve the stretch flanging performance, the breaking elongation, and the shock resistance focusing on high tension steels which were manufactured by reheating continuously cast slab followed by hot-rolling thereof or which were manufactured by directly hot-rolling the continuously cast slab without reheating. Thus, the inventors of the present invention found that the stretch flanging performance and the breaking elongation are influenced by the presence of a banded structure enriched with C, Mn, or the like at center portion of the sheet thickness, and that the improvement in shock resistance becomes effective when the yield strength of the material is increased to a level that does not degrade the workability of the material.

These findings were further investigated to derive the present invention. That is, the present invention provides:

1. A method for manufacturing steel sheet consisting essentially of 0.05 to 0.14% C, 0.5% or less Si, 0.5 to 2.5% Mn, 0.05% or less P, 0.01% or less S, 0.005% or less O, and less than 0.0005% Ca, by weight, which method comprises the steps of: (1) forming a slab by continuous casting conducting treatment to reduce segregation; (2) hot-rolling the slab at end temperatures of finish-rolling of $Ar_3$ transformation point or above; (3) starting the primary cooling within 2 seconds after completed the hot-rolling at cooling speeds of from 100 to 2,000° C./sec to cool the hot-rolled steel sheet to temperatures of from 600 to 750° C.; (4) applying the secondary cooling after the primary cooling at cooling speeds of less than 50° C./sec, followed by applying coiling to the secondary cooled hot-rolled steel sheet at temperatures of from 450 to 650° C.

2. A method for manufacturing steel sheet consisting essentially of 0.05 to 0.14% C, 0.5% or less Si, 0.5 to 2.5% Mn, 0.05% or less P, 0.01% or less S, 0.005% or less O, and less than 0.0005% Ca, by weight, which method comprises the steps of: (1) forming a slab by continuous casting conducting treatment to reduce segregation; (2) reheating the slab before applying hot-rolling; (3) hot-rolling the slab at end temperatures of finish-rolling of $Ar_3$ transformation point or above; (4) starting the primary cooling within 2 seconds after completed the hot-rolling at cooling speeds of from 100 to 2,000° C./sec to cool the hot-rolled steel sheet to temperatures of from 600 to 750° C.; (5) applying the secondary cooling after the primary cooling at cooling speeds of less than 50° C./sec, followed by applying coiling to the secondary cooled hot-rolled steel sheet at temperatures of from 450 to 650° C.

3. The method for manufacturing steel sheet described in either of above-given 1 or 2, while further adding either one of the steps of: (1) applying annealing after pickling; and (2) applying cold-rolling after pickling, followed by annealing.

4. The method for manufacturing steel sheet described in either one of the above-given 1 through 3, in which the steel further contains 0.01 to 0.3% as sum of one or more of Ti, Nb, V, Mo, Zr, and Cr.

According to the present invention, the composition and the manufacturing conditions are specified to attain the effect of the invention. The detail of the reasons of specification is described in the following.

1. Composition

Carbon

Carbon is added to secure the strength of the steel sheet. If the C content is less than 0.05%, the strength of 340 MPa or more, which is a target of the present invention, cannot be attained. If the C content exceeds 0.14%, the degradation of workability significantly degrades. Accordingly, the C content is specified to a range of from 0.05 to 0.14%.

Silicon

Silicon is an element to strengthen the solid solution, thus S is added to strengthen the steel sheet. If, however, the S content exceeds 0.5%, the surface property degrades. Consequently, the S content is specified to 0.5% or less.

Manganese

Manganese is added to 0.5% or more for improving the toughness of the steel sheet and to increase the strength by strengthening the solid solution. If the Mn content exceeds 2.5%, the workability significantly degrades. Therefore, the Mn content is specified to a range of from 0.5% to 2.5%.

Phosphorus

Phosphorus has a function to strengthen the solid solution to strengthen the steel sheet. If, however, the P content exceeds 0.05%, the workability degrades owing to segregation. Consequently, the P content is specified to 0.05% or less.

Sulfur

Sulfur forms sulfide, and the quantity of sulfide increases to degrade the workability if the S content exceeds 0.01%. Accordingly, the S content is specified to 0.01% or less.

Oxygen

Oxygen is specified to 0.005% or less to suppress crack generation on the surface of slab or under the surface layer of the slab during continuous casting.

Calcium

Calcium converts alumina oxide, which is a deoxidized product in the case of Al application for deoxidizing during steel melt manufacturing stage, into a low melting point Al—Ca—O base oxide. Since the Al—Ca—O base oxide extends during hot-rolling to degrade the workability (stretch flanging performance), the present invention treats Ca as an inevitable impurity. Consequently, Ca is not positively added, and the Ca content is specified to less than 0.005% which is a level of non-addition case.

The present invention deals with the above-given elements as the basic composition components. Nevertheless, to further improve the characteristics, one or more of Ti, Nb, V, Mo, Zr, and Cr may further be added.

Ti, Nb, V, Mo, Zr, Cr

According to the present invention, 0.01 to 0.3% as the sum of one or more of Ti, Nb, V, Mo, Zr, and Cr can be added for improving the strength.

According to the present invention, presence of elements other than those described above is allowable as far as they do not give bad influence on the functions and effect of the present invention. For example, presence of 2% or less Cu and 0.04% or less Sn is allowable.

2. Manufacturing Conditions (1) Step of forming slab by continuous casting that conducts treatment to reduce segregation To reduce the production cost and to manufacture slab at high yield, the present invention applies continuous casting.

During the casting stage, the treatment to reduce segregation is conducted to suppress the segregation of C, Mn, and the like during the continuous casting, to prevent the formation of a banded structure at center portion of the sheet thickness and the like, thus to attain excellent workability (stretch flanging performance), combining with the control of primary cooling speed after the finish-rolling (described after). Examples of the treatment to reduce segregation are electromagnetic agitation, light draft casting, and increase in cooling speed of ingot such as slab. These treatment methods can be applied separately or combined together.

(2) Step of reheating the slab before hot-rolling

For improving the uniformity of temperature in a slab, for homogenizing the mechanical properties in the coil width direction, and for further improving the workability, it is preferable to reheat the slab after continuous casting without cooling thereof to room temperature and to start rough-rolling. The reheating temperature is preferably not higher than 1,250° C.

(3) Step of hot-rolling regulating the end temperature of the finish-rolling to $Ar_3$ transformation point or above The end temperature of rolling at the finish-rolling mill is selected to $Ar_3$ transformation point or above to refine the ferritic grains and the pearlite after the transformation, thus improving the stretch flanging performance and the shock resistance.

(4) Step of starting primary cooling at cooling speeds of from 100 to 2,000° C./sec within 2 seconds after the hot-rolling, and to conduct the cooling to temperatures of from 600 to 750° C.

The cooling (primary cooling) on runout table after the hot-rolling starts within 2 seconds, preferably within 1 second, after the finish-rolling for reducing the size of ferritic grains and of pearlite after the transformation, thus improving the excellent workability and shock resistance with high yield strength. FIG. 1 shows the influence of the time to start cooling on the mechanical properties. In the case that the cooling started within 2 seconds after completing the finish-rolling, excellent workability and high strength can be attained.

The cooling speed of the primary cooling is specified to refine the ferritic grains and the pearlite after the transformation and to improve the stretch flanging performance by the suppression of banded structure formation at center portion of the sheet thickness. The place of banded structure corresponds to the C and Mn enriched portion during the solidification step. At ordinary cooling speeds of 100° C./sec or less, the temperature of transformation from austenite to ferrite is low, and the banded structure transforms slower than any other portion. As a result, lots of pearlite are formed in the banded structure to degrade the stretch flanging performance.

If the cooling speed is 100° C./sec or more, the ferrite transformation becomes easy even in the C and Mn enriched portion, which gives homogeneous elements distribution to suppress the banded structure formation. Higher cooling speed is more preferable. In view of industrial applicability, however, the upper limit of the cooling speed is 2,000° C./sec. For the case of Comparative Method that applies the cooling speed outside of the range of present invention, the banded structure is observed, and the grain size is larger than that of the microstructure of the method of the present invention.

From the standpoint of refining the ferritic grains and the pearlite, the cooling speed is preferably 200° C./sec or more, and more preferably 400° C./sec or more for further improving the workability.

If the end temperature of the primary cooling is higher than 750° C., the ferritic grain refinement becomes difficult. And if it is less than 600° C., the secondary phase becomes a hard low temperature transformation phase. Therefore, the end temperature of the primary cooling is specified to a range of from 600° C. or more and less than 750° C.

(5) Step of applying secondary cooling after the primary cooling at cooling speeds of less than 50° C./sec, then to apply coiling at temperatures of from 450 to 650° C.

Succeeding to the primary cooling, the secondary cooling is applied. The secondary cooling may be given immediately after the stop of the primary cooling or by given after a certain period of time to stand for cooling. That is, the time to start the secondary cooling is not specifically specified. The cooling speed of the secondary cooling is specified to 50° C./sec or less to let the austenite structure adequately transform into pearlite structure to give excellent workability.

The coiling temperature is regulated to a range of from 450 to 650° C. because the coiling temperatures above 650° C. induces formation of pearlite which is harmful to ductility and because the temperatures below 450° C. induces formation of low temperature transformed phase to degrade the workability. When further homogenized mechanical properties are wanted, the temperature difference in a coil is preferably to be regulated within 50° C. by applying, for example, a cooling unit having excellent cooling controllability.

On applying the present invention, application of pickling and annealing, or pickling, cold-rolling, and annealing after manufactured the hot-rolled steel sheet does not degrade the effect of the present invention. Furthermore, the effect of the present invention is not degraded even when a hot dip zinc-coated material is used as substrate of hot-rolling and cold-rolling.

In addition, on applying the present invention, application of an induction heating unit after the rough-rolling, before the finish-rolling, or between the stands of finish-rolling to heat the edge portions in width direction of coil gives further homogenized mechanical properties. Furthermore, the effect of the present invention is not harmed even under continuous hot-rolling in which the sheet bar is welded after the rough-rolling followed by continuous finish-rolling.

Example

After the melt preparation of steels having the chemical compositions shown in Table 6 according to the present invention, hot-rolled steel sheets having a thickness of 2.0 mm were manufactured using the manufacturing method given in Table 7. For the materials Nos. 1 and 2 and Nos. 5 through 9, the mechanical properties in as-hot-rolled state were determined. For the material No. 3, the mechanical properties were determined after hot-rolled, pickled, cold-rolled, and hot dip galvanized. For the material No. 4, the mechanical properties were determined after hot-rolled, pickled, and hot dip galvanized. As the evaluation of stretch flanging performance, the bore expanding rate (λ) was determined. Table 7 also gives the evaluation result.

Figure 2:
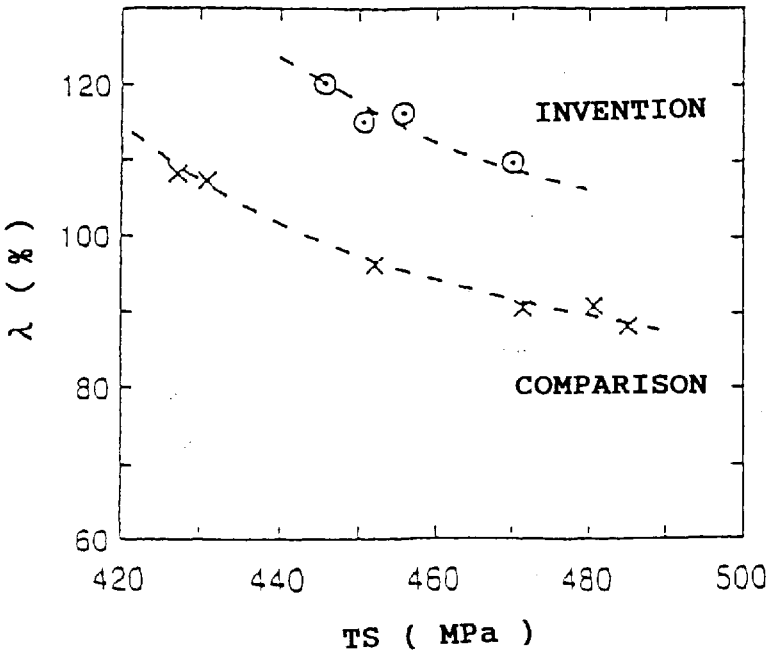
FIG. 2 shows the relation between the tensile strength and the bore expanding rate according to the Preferred embodiment 2.
Figure 3:
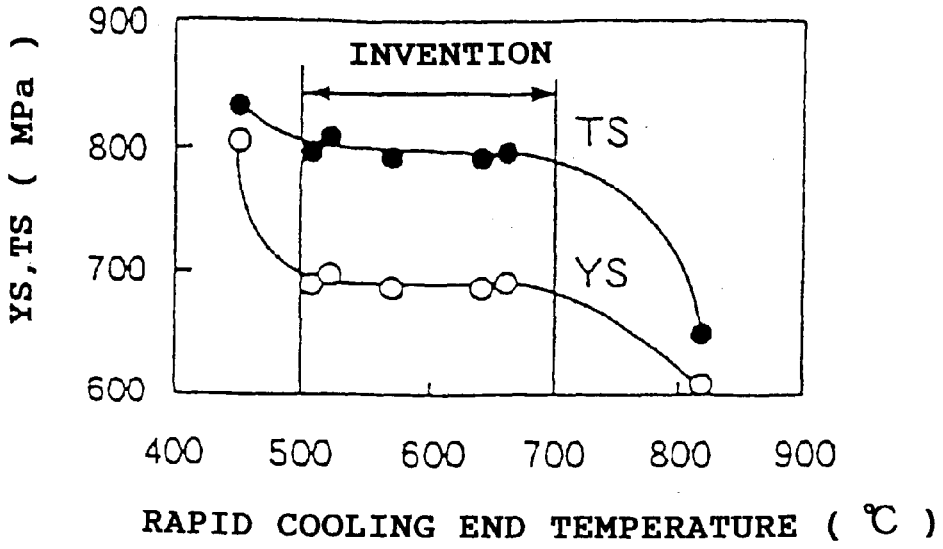
FIG. 3 shows the influence of the temperature to stop the rapid cooling (primary cooling) on the strength characteristics (TS, YS) according to the Preferred embodiment 3.
Figure 4:
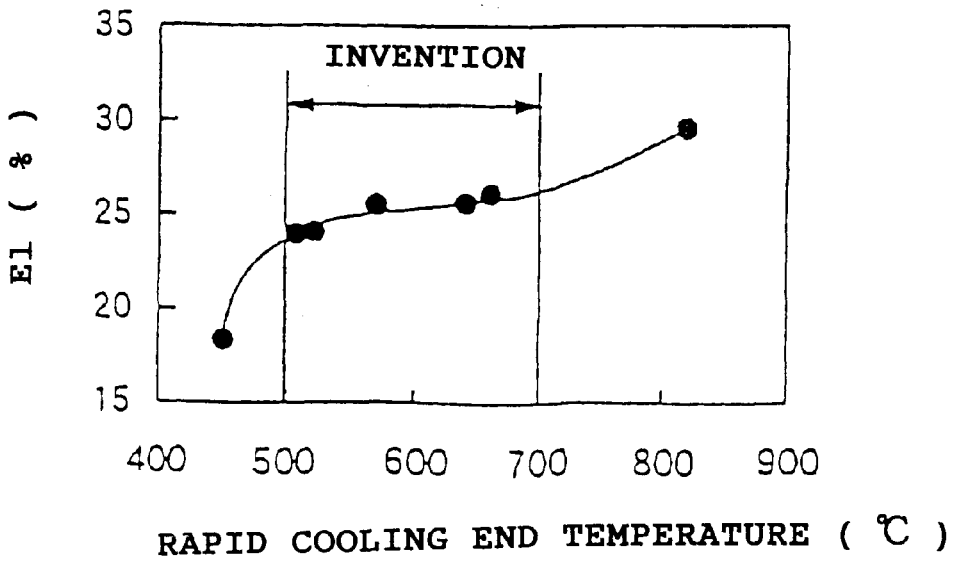
FIG. 4 shows the influence of the temperature to stop the rapid cooling (primary cooling) on the strength characteristic (EI) according to the Preferred embodiment 3.
Figure 5:
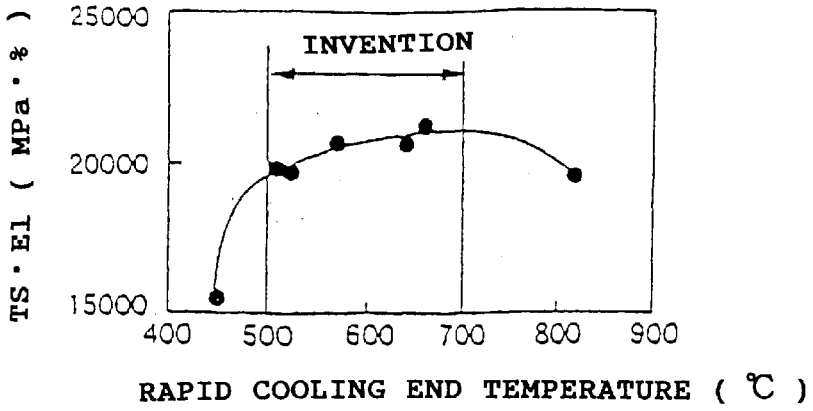
FIG. 5 shows the influence of the temperature to stop the rapid cooling (primary cooling) on the strength characteristics (TS, EI) according to the Preferred embodiment 3.
Figure 6:
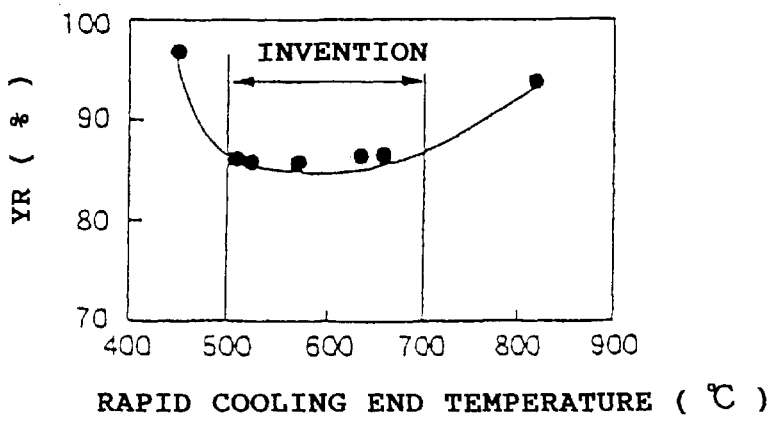
FIG. 6 shows the influence of the temperature to stop the rapid cooling (primary cooling) on the strength characteristic (YR) according to the Preferred embodiment 3.
Figure 7:
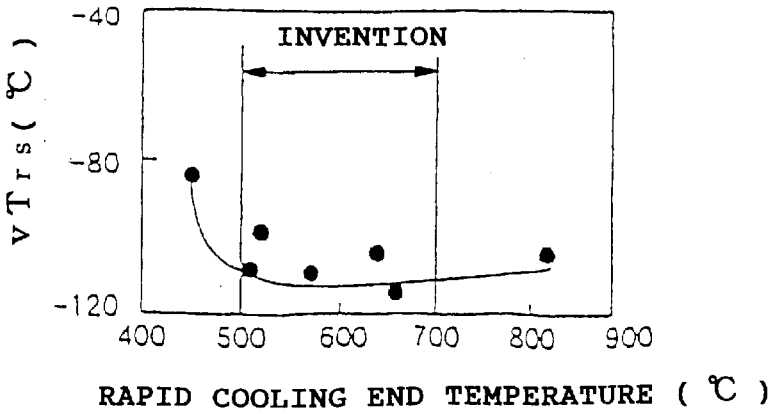
FIG. 7 shows the influence of the temperature to stop the rapid cooling (primary cooling) on the toughness according to the Preferred embodiment 3.

The materials Nos. 1 through 4 as the Examples of the present invention, satisfying the chemical compositions and manufacturing conditions of the present invention were compared with the materials Nos. 5 through 9 as the Comparative Examples failing to satisfy either one of the manufacturing conditions of the present invention. The materials of Examples of the present invention definitely superior in workability (balance of strength and bore expanding rate), high yield strength, and superior shock resistance. FIG. 2 shows the tensile strength and the bore expanding rate of both the Examples and the Comparative Examples. It is clearly shown that the present invention provides excellent characteristics.

TABLE 6

| Chemical composition (wt. %) | | | | | | | | |
|---|---|---|---|---|---|---|---|---|
| C | Si | Mn | S | P | O | N | Ca | Remark |
| 0.059 | 0.01 | 1.23 | 0.007 | 0.013 | 0.0023 | 0.0037 | — | Example |

TABLE 7

| Classification | Material No. | Slab: Heat history | Slab: Treatment to reduce segregation | End temperature of rolling (° C.) | Time to start the primary cooling (sec) | Primary cooling speed (° C./sec) | End temperature of the primary cooling (° C.) | Secondary cooling speed (° C./sec) | Coiling temperature (° C.) | Mechanical properties: YS (° C.) | TS (MPa) | EL (%) | λ (%) | Remark |
|---|---|---|---|---|---|---|---|---|---|---|---|---|---|---|
| Example | 1 | heating to 1250° C. | Applied | (Ar3) ~ (Ar3 + 30) | 1.5 | 210 | 650 | 40 | 600 | 382 | 451 | 352 | 115 | Hot-rolled material |
| | 2 | heating to 1250° C. | Applied | (Ar3) ~ (Ar3 + 20) | 0.3 | 200 | 680 | 35 | 605 | 397 | 470 | 32.5 | 110 | Hot-rolled material |
| | 3 | heating to 1250° C. | Applied | (Ar3) ~ (Ar3 + 20) | 0.3 | 200 | 680 | 35 | 605 | 379 | 446 | 36.2 | 120 | Cold-rolled and galvanized material |

TABLE 7-continued

| Classification | Material No. | Slab Heat history | Slab Treatment to reduce segregation | End temperature of rolling (° C.) | Time to start the primary cooling (sec) | Primary cooling speed (° C./sec) | End temperature of the primary cooling (° C.) | Secondary cooling speed (° C./sec) | Coiling temperature (° C.) | Mechanical properties YS (° C.) | TS (MPa) | EL (%) | λ (%) | Remark |
|---|---|---|---|---|---|---|---|---|---|---|---|---|---|---|
| | 4 | heating to 1250° C. | Applied | (Ar3) ~ (Ar3 + 20) | 0.3 | 200 | 680 | 35 | 605 | 387 | 456 | 35 | 116 | Hot-rolled and galvanized material |
| Comparative example | 5 | heating to 1250° C. | Not applied* | (Ar3 + 10) ~ (Ar3 + 30) | 0.3 | 205 | 670 | 40 | 600 | 395 | 471 | 31.5 | 91 | Hot-rolled material |
| | 6 | heating to 1250° C. | Applied | (Ar3 + 10) ~ (Ar3 + 20) | 0.6 | 30* | 650 | 35 | 610 | 353 | 427 | 32 | 108 | Hot-rolled material |
| | 7 | heating to 1250° C. | Applied | (Ar3 + 10) ~ (Ar3 + 30) | 0.6 | 205 | 550* | 20 | 605 | 402 | 485 | 26 | 88 | Hot-rolled material |
| | 8 | heating to 1250° C. | Applied | (Ar3 + 5) ~ (Ar3 + 30) | 0.6 | 195 | 680 | 35 | 660* | 346 | 431 | 31.5 | 107 | Hot-rolled material |
| | 9 | heating to 1250° C. | Applied | (Ar3 + 10) ~ (Ar3 + 20) | 0.6 | 195 | 690 | 40 | 430* | 397 | 480 | 26.5 | 91 | Hot-rolled material |

Note)
The (*) mark indicates that the material is outside of the scope of the present invention.

PREFERRED EMBODIMENT 3

The inventors of the present invention conducted detail study on the compositions, the rolling conditions, and the cooling conditions after the rolling, and found that the stability of strength characteristics are particularly influenced by the cooling conditions after the rolling. Thus the inventors derived the present invention. That is, the present invention provides:

1. A method for manufacturing high tension steel sheet comprising the steps of: hot-rolling a steel consisting essentially of 0.03 to 0.12% C, 1% or less Si, 0.5 to 2% Mn, 0.02% or less P, 0.01% or less S, further at least one element selected from the group consisting of 0.005 to 0.1% Nb, 0.005 to 0.1% V, and 0.005 to 0.1% Ti, by weight, at temperatures of 1,070° C. or less to accumulated reductions in thickness of 30% or more; and cooling the hot-rolled steel sheet within 6 seconds after completing the rolling at average cooling speeds of not less than 80° C./sec to temperatures of above 500° C. and not more than 700° C.

2. A method for manufacturing high tension steel sheet comprising the steps of: hot-rolling a steel consisting essentially of 0.03 to 0.12% C, 1% or less Si, 0.5 to 2% Mn, 0.02% or less P, 0.01% or less S, and 0.05 to 0.5% Mo, by weight, at temperatures of 1,070° C. or less to accumulated reductions in thickness of 30% or more; and cooling the hot-rolled steel sheet within 6 seconds after completing the rolling at average cooling speeds of not less than 80° C./sec to temperatures of above 500° C. and not more than 700° C.

3. The method for manufacturing high tension steel sheet of described in above-given 1, wherein the steel further contains 0.05 to 0.5% Mo.

The reasons to specify the compositions and the manufacturing conditions according to the present invention are described below.

1. Composition

Carbon

Carbon is added to secure the strength of the steel sheet. If the C content is less than 0.03%, the effect cannot be attained. If the C content exceeds 0.12%, the formation of low temperature transformation phase occurs to excessively increase the strength. Accordingly, the C content is specified to a range of from 0.03 to 0.12%.

Silicon

Silicon is added to enhance the ferrite precipitation and to prevent excessive increase in YS. If, however, the S content exceeds 1%, the weldability degrades. Consequently, the S content is specified to 1% or less.

Manganese

Manganese is added for strengthening the solid solution, for improving hardenability, and for improving the strength. If the Mn content is less than 0.5%, the effect cannot be attained. If the Mn content exceeds 2%, the workability degrades and the toughness degrades owing to the increase in the low temperature transformation phase. Therefore, the Mn content is specified to a range of from 0.5% to 2%.

Phosphorus and Sulfur

Since these elements degrade the toughness of steel, the P content is specified to 0.02% or less and the S content is specified to 0.01% or less.

According to the present invention, one or more of Nb, V, Ti, and Mo are added to improve the strength.

Nb, V, Ti

The elements Nb, V, and Ti are the precipitation hardening elements, and they establish fine microstructure of hot-rolled steel sheet to increase the strength. To give the effect, each of these element is added to 0.005% or more. Excessive amount of these elements saturates the effect and degrades the weldability, and further degrades the toughness owing to the increase in low temperature transformation phase. Therefore, the upper limit of the addition of each of these element is specified to 0.1%.

Molybdenum

Molybdenum improves the hardenability, strengthens the structure, and increases the strength. To attain the effect, Mo is added to 0.05% or more. However, excessive addition of Mo degrades the weldability and the toughness owing to the increase in low temperature transformation phase. Consequently, the Mo content is specified to 0.5% or less.

According to the present invention, presence of elements other than those described above is allowable as far as they do not give bad influence on the functions and effect of the present invention. For example, presence of 0.1% or less Al, Cu, Ni, B, Ca or the like and 0.05% or less B and Ca is allowable.

2. Rolling Condition

To establish uniform fine microstructure of hot-rolled steel by the rolling in recrystallization temperature region, the rolling is conducted at temperatures of 1,070° C. or below with cumulative reduction in thickness of 30% or more.

3. Cooling Condition

Time to start cooling

To refine the grains and to stabilize the strength and the toughness, the cooling is started within 6 seconds after completed the rolling. For improving the strength and the toughness by the grain refinement effect, preferably the time to start cooling is within 3 seconds.

Average cooling speed

The cooling speed is the most important variable in the present invention. Rapid cooling is adopted to prevent formation of coarse grains and to assure homogeneous fine grains, with the average cooling speeds of 80° C./sec or more, preferably 100° C./sec or more.

Temperature to stop cooling

When the temperature to stop cooling is low, the low temperature transformed phase increases and the YS significantly increases to excessively increase the YR and to degrade the toughness. Therefore the temperature to stop cooling is specified to 500° C. or more. On the other hand, if the temperature to stop cooling exceeds 700° C., the stability of strength cannot be obtained. Consequently, the temperature to stop cooling is specified to a range of from higher than 500° C. to not higher than 700° C.

According to the present invention, the steps after the stop of the rapid cooling are not specifically specified. In the case that winding is applied to form a coil, the process follows common practice to apply slow cooling by air cooling or by runout table cooling followed by coiling. In that case, the slow cooling gives preferable effect of reducing the formation of low temperature transformation phase and of suppressing excessive increase in YS value, thus, particularly the slow cooling at 40° C./sec or less is preferred.

On applying the present invention, application of an induction heating unit at inlet of the continuous hot finish-rolling mill, or between the stands of the continuous hot finish-rolling mill to heat the sheet bar, and further application of an induction heating unit between the stands of the continuous hot finish-rolling mill or the preceding step to the finish-rolling mill to heat the edge portions in width direction of the sheet bar assure the homogenization of mechanical properties, thus the heating does not induce problem.

When the present invention is applied to a continuous hot-rolling process using a coil box, the heating of sheet bar may be given before or after the coil box or before or after the roughing mill, or after the coil box, or before or after the welder, without raising problem.

Example

With the steels satisfying the chemical compositions given in Table 8 according to the present invention, the influence of the variations in manufacturing conditions on the strength characteristics was investigated. The manufacturing conditions were varied in terms of the temperature to stop the primary cooling, which are given in Table 9. The primary cooling in the table expresses the rapid cooling after the rolling, and the secondary cooling therein expresses the slow cooling after the stop of the primary cooling and before the coiling.

Regarding the specimens Nos. 1 through 6, No. 1 and No. 6 are the Comparative Examples giving the temperatures to stop the primary cooling above 500° C. and not more than 700° C., which are outside of the range of the present invention. The manufacturing conditions of the specimens Nos. 2 through 5 are within the range of the present invention, varying the temperature to stop the primary cooling, showing the Examples of the present invention. All the specimens had 7 mm in sheet thickness. The result of mechanical properties determination is shown in Table 10. FIGS. 3 through 7 show the result of mechanical property test given in Table 10. The specimens given in FIGS. 3 through 7 corresponded to 150° C./sec of the primary cooling speed and to 3° C./sec of the secondary cooling speed. In the figures, the rapid cooling expresses the primary cooling.

As clearly seen in the tables and figures, according to the conditions within the range of the present invention, the variations in strength characteristics of the obtained steel sheets are less to provide stable characteristics even under varied manufacturing conditions.

TABLE 8

| C | Si | Mn | P | S | Nb | V | Ti |
|---|---|---|---|---|---|---|---|
| 0.08 | 0.25 | 1.57 | 0.006 | 0.0009 | 0.034 | 0.072 | 0.039 |

TABLE 8

| Specimen | Heating temperature (° C.) | Rolling: 1070° C. or below | Finishing temperature (° C.) | Time to start cooling (sec) | Primary cooling speed (° C./sec) | Temperature to stop the primary cooling (° C.) | Secondary cooling speed (° C./sec) | Coiling temperature (° C.) | Remark |
|---|---|---|---|---|---|---|---|---|---|
| 1 | 1230 | 47 → 7 mmt | 820 | — | — | 820* | 3 | 570 | C |
| 2 | 1230 | 47 → 7 mmt | 820 | 0.6 | 150 | 660 | 3 | 570 | E |

TABLE 8-continued

| Specimen | Heating temperature (° C.) | Rolling: 1070° C. or below | Finishing temperature (° C.) | Time to start cooling (sec) | Primary cooling speed (° C./sec) | Temperature to stop the primary cooling (° C.) | Secondary cooling speed (° C./sec) | Coiling temperature (° C.) | Remark |
|---|---|---|---|---|---|---|---|---|---|
| 3 | 1230 | 47 → 7 mmt | 820 | 0.6 | 150 | 640 | 3 | 570 | E |
| 4 | 1230 | 47 → 7 mmt | 820 | 0.6 | 150 | 570 | — | 570 | E |
| 5 | 1230 | 47 → 7 mmt | 820 | 0.6 | 150 | 520 | — | 520 | E |
| 6 | 1230 | 47 → 7 mmt | 820 | 0.6 | 150 | 450* | — | 450 | C |

C Comparative example
E: Example

TABLE 10

| Specimen | YS (MPa) | TS (MPa) | EI (%) | TS · EI (MPa · %) | YR (%) | vTrs (° C.) |
|---|---|---|---|---|---|---|
| 1 | 612 | 652 | 30 | 19560 | 93.9 | −105 |
| 2 | 695 | 800 | 26.5 | 21200 | 86.9 | −115 |
| 3 | 688 | 795 | 26 | 20670 | 86.5 | −105 |
| 4 | 685 | 797 | 25.8 | 20004 | 85.9 | −110 |
| 5 | 699 | 806 | 24.2 | 19650 | 86 | −100 |
| 6 | 808 | 836 | 18.5 | 15466 | 96.7 | −85 |

What is claimed is:

1. A method for manufacturing a steel sheet comprising the steps of:

(a) rough-rolling a continuously cast slab containing C in an amount consisting essentially of 0.8% or less by weight to form a sheet bar;

(b) finish-rolling the sheet bar from step (a) at a finishing temperature of ($Ar_3$ transformation point—20° C.) or more to form a steel strip;

(c) rapidly cooling the steel strip from step (b) in a primary cooling step after completion of the finish-rolling at a cooling speed of 200° C./sec or more to a temperature of from 500 to 800° C.;

(d) cooling the cooled steel strip from the primary cooling step (c) in a secondary cooling step at a cooling speed of less than 60° C./sec; and (e) coiling the cooled steel strip from the secondary cooling step (d) at a coiling temperature of from 400 to 750° C. to form a coiled steel sheet.

2. The method of claim 1, wherein the continuously cast slab contains 0.8% or less C, 2.5% or less Si, and 3.0% or less Mn, by weight.

3. The method of claim 1, wherein the continuously cast slab contains 0.8% or less C, 2.5% or less Si, 3.0% or less Mn, and 0.01 to 0.2% of at least one element selected from the group consisting of Ti, Nb, V, Mo, Zr, and Cr, by weight.

4. The method of claim 1, wherein the continuously cast slab contains 0.8% or less C, 2.5% or less Si, 3.0% or less Mn, and 0.005% or less of at least one element selected from the group consisting of Ca and B, by weight.

5. The method of claim 1, wherein the continuously cast slab contains 0.8% or less C, 2.5% or less Si, 3.0% or less Mn, 0.01 to 0.2% of at least one element selected from the group consisting of Ti, Nb, V, Mo, Zr, and Cr, and 0.005% or less at least one element selected from the group consisting of Ca and B, by weight.

6. The method of claim 1, wherein the rough-rolling of the continuously cast slab is carried out by direct hot-rolling.

7. The method of claim 1, wherein the rough-rolling of the continuously cast slab is carried out by reheating the slab to a temperature of 1,200° C. or below before cooling thereof to room temperature.

8. The method of claim 1, further comprising the step of heating the sheet bar by an induction heating unit immediately before the finish-rolling or during the finish-rolling.

9. The method of claim 1, wherein the rapid cooling of the steel strip in step (c) is started within a time ranging from more than 0.1 second and less than 1 second after completing the finish-rolling.

10. The method of claim 1, further comprising the steps of: cold-rolling the coiled steel strip to form a cold-rolled coiled steel strip; and annealing the cold-rolled coiled steel strip.

11. The method of claim 1, wherein the rapid cooling step (c) is carried out so that the temperature difference between the maximum value and the minimum value in a width direction and in a longitudinal direction of the steel strip after the rapid cooling is 60° C. or less.

12. The method of claim 1, wherein the rapid cooling step (c) is carried out by cooling the steel strip at a heat transfer coefficient of 2,000 $kcal/m^2h°$ C. or more.

13. A steel sheet prepared by the method for manufacturing a steel sheet of claim 1, the steel sheet having variations of tensile strength in a width direction and in a longitudinal direction thereof within ±8% of an average value of the tensile strength in a coil.

14. A method for manufacturing a steel sheet comprising the steps of:

(a) rough-rolling a continuously cast slab containing C in an amount consisting essentially of more than 0.8% and 1% or less by weight to form a sheet bar;

(b) finish-rolling the sheet bar from step (a) at a finishing temperature of (Acm transformation point—20° C.) or more to form a steel strip;

(c) rapidly cooling the steel strip in a primary cooling step after completing the finish-rolling at a cooling speed of 200° C./sec or more to a temperature of from 500 to 800° C.;

(d) cooling the cooled steel strip from the primary cooling step (c) in a secondary cooling step at a cooling speed of less than 60° C./sec; and (e) coiling the cooled steel strip after the secondary cooling step (d) at a coiling temperature of from 400 to 750° C. to form a coiled steel strip.

15. The method of claim 14, wherein the rough-rolling of the continuously cast slab is carried out by direct hot-rolling.

16. The method of claim 14, wherein the rough-rolling of the continuously cast slab is carried out by reheating the slab to a temperature of 1,200° C. or less before cooling thereof to room temperature.

17. The method of claim 14, further comprising the step of heating the sheet bar by an induction heating unit immediately before the finish-rolling or during the finish-rolling.

18. The method of claim 14, wherein the rapid cooling of the steel strip in step (c) is started within a time ranging from more than 0.1 second and less than 1 second after completing the finish-rolling.

19. The method of claim 14, further comprising the steps of: cold-rolling the coiled steel strip to form a cold-rolled coiled steel strip; and annealing the cold-rolled coiled steel strip.

20. The method of claim 14, wherein the rapid cooling step (c) is carried out so that the temperature difference between the maximum value in a width direction and in a longitudinal direction of the steel strip after the rapid cooling is 60° C. or less.

21. The method of claim 14, wherein the rapid cooling step (c) is carried out by cooling the steel strip at a heat transfer coefficient of 2,000 kcal/$m^2$h° C. or more.

22. A steel sheet prepared by the method for manufacturing a steel sheet of claim 14, the steel sheet having variations of tensile strength in a width direction and in a longitudinal direction thereof within ±8% of an average value of the tensile strength in a coil.

23. The method according to claim 1, wherein the primary cooling step comprises cooling the steel strip at a cooling speed of 400° C./sec. or more.

24. The method according to claim 14, wherein the primary cooling step comprises cooling the steel strip at a cooling speed of 400° C./sec or more.

* * * * *